US007749110B2

(12) United States Patent
Bozof

(10) Patent No.: US 7,749,110 B2
(45) Date of Patent: Jul. 6, 2010

(54) RACQUET SPORT TRAINING SYSTEM

(75) Inventor: Morris Bozof, Memphis, TN (US)

(73) Assignee: Great Southern Corporation, Memphis, TN (US)

( * ) Notice: Subject to any disclaimer, the term of this patent is extended or adjusted under 35 U.S.C. 154(b) by 0 days.

(21) Appl. No.: 11/967,913

(22) Filed: Dec. 31, 2007

(65) Prior Publication Data

US 2009/0011869 A1 Jan. 8, 2009

Related U.S. Application Data

(60) Provisional application No. 60/948,006, filed on Jul. 5, 2007.

(51) Int. Cl.
*A63B 69/00* (2006.01)
*A63B 69/38* (2006.01)

(52) U.S. Cl. ..... 473/424; 473/422; 473/450; 473/458; 473/464

(58) Field of Classification Search ..... 473/422, 473/425, 429, 423–426, 435, 573; D21/715, D21/719
See application file for complete search history.

(56) References Cited

U.S. PATENT DOCUMENTS 2,094,536 A * 9/1937 Heimers ..... 473/425
2,128,610 A * 8/1938 Heimers ..... 473/425
2,945,695 A 7/1960 Heimers et al.
3,065,563 A 11/1962 Bascom
3,635,475 A 1/1972 Brown
3,709,490 A 1/1973 Pruss
4,027,880 A * 6/1977 Hadtke ..... 473/426
4,071,239 A 1/1978 Ferguson
4,076,239 A * 2/1978 Hall ..... 473/463
4,088,316 A * 5/1978 Szafianski ..... 473/426
4,095,787 A * 6/1978 Saferstein ..... 473/423
4,161,313 A * 7/1979 Dickey ..... 473/449
4,174,107 A 11/1979 Hickey
D260,921 S * 9/1981 Mena ..... D21/753
4,752,070 A 6/1988 Hansen et al.
4,761,007 A * 8/1988 Boschian ..... 473/522
4,909,509 A * 3/1990 Boschian ..... 473/522

(Continued)

FOREIGN PATENT DOCUMENTS

CN 2587463 Y 11/2003

OTHER PUBLICATIONS

U.S. Appl. No. 29/296,112 titled "Connection Disc for Racquet Sport Ball" filed Oct. 2007 (with drawings).

(Continued)

*Primary Examiner*—Mitra Aryanpour
(74) *Attorney, Agent, or Firm*—Ronald E. Greigg

(57) ABSTRACT

The present invention provides a tennis training systems. Methods of practicing and teaching tennis are also provided herein. In one aspect, the training system employs an elongated, elastic cord having a proximal end and a distal end, a vibration dampener configured to be received within a string bed of a racket and operatively connected to the proximal end of the cord, and a connection disc operatively connected to the distal end of the cord. The vibration dampener is connected to the proximal end of the cord by means of an integral loop. Optionally, the connection disc is releasably connected to the distal end of the cord by means of an integral loop.

15 Claims, 8 Drawing Sheets

U.S. PATENT DOCUMENTS

| | | | | | |
|---|---|---|---|---|---|
| 4,927,143 | A | * | 5/1990 | Hillock | 473/522 |
| 5,088,732 | A | | 2/1992 | Kim | |
| 5,106,086 | A | * | 4/1992 | Acosta | 473/522 |
| D331,436 | S | * | 12/1992 | Yanahara | D21/729 |
| 5,244,206 | A | * | 9/1993 | Clark et al. | 273/DIG. 19 |
| 5,344,138 | A | | 9/1994 | Hellriegel | |
| 5,393,050 | A | | 2/1995 | Lloyd | |
| 5,618,040 | A | | 4/1997 | Parten | |
| 5,649,699 | A | | 7/1997 | Todoroff | |
| 5,665,017 | A | * | 9/1997 | Walters | 473/573 |
| 5,713,805 | A | * | 2/1998 | Scher et al. | 473/426 |
| 5,772,542 | A | * | 6/1998 | Gildea et al. | 473/576 |
| 5,776,020 | A | * | 7/1998 | Barone | 473/522 |
| 5,792,011 | A | * | 8/1998 | Kuebler | 473/520 |
| 5,797,812 | A | * | 8/1998 | Liu | 473/522 |
| 5,944,622 | A | * | 8/1999 | Buck et al. | 473/437 |
| D420,412 | S | * | 2/2000 | Buck et al. | D21/755 |
| 6,033,324 | A | * | 3/2000 | Nashif et al. | 473/520 |
| 6,062,993 | A | | 5/2000 | Rodriguez | |
| 6,224,523 | B1 | | 5/2001 | Peng | |
| 6,268,413 | B1 | | 7/2001 | Columbus | |
| 6,447,411 | B1 | * | 9/2002 | Bianchi | 473/522 |
| 6,659,891 | B2 | | 12/2003 | Lloyd | |
| 6,692,420 | B2 | * | 2/2004 | Walden | 482/148 |
| 6,893,431 | B2 | | 5/2005 | Naimark et al. | |
| 7,048,653 | B2 | | 5/2006 | Heimers | |
| 7,140,986 | B2 | | 11/2006 | Howe | |
| D539,366 | S | | 3/2007 | Niksich | |
| D539,372 | S | * | 3/2007 | Do | D21/753 |
| D565,674 | S | * | 4/2008 | Bozof | D21/715 |
| 7,530,910 | B1 | * | 5/2009 | Niksich et al. | 473/522 |
| 2006/0079352 | A1 | * | 4/2006 | Sung | 473/520 |
| 2007/0265120 | A1 | * | 11/2007 | Hickey | 473/520 |
| 2009/0011869 | A1 | * | 1/2009 | Bozof | 473/424 |

OTHER PUBLICATIONS

U.S. Appl. No. 29/284,795 titled "Vibration Dampener for Sports Racquet" filed Sep. 14, 2007 (with drawings).

Qiangli Sporting Goods Co., Ltd. product list for training set (4 pages) http://www.qiangli.com/en/tennis available at least as of Nov. 1, 2007.

Qiangli tennis racket with "rebound buckle" (1 page) http://www.qiangli.com/en/pro_show.asp?id=1955 available at least as of Nov. 1, 2007.

Qiangli tennis racket with "rebound buckle" (1 page) http://www.qiangli.com/en/pro_show.asp?id=1954 available at least as of Nov. 1, 2007.

Qiangli tennis racket with "rebound buckle" (1 page) http://www.qiangli.com/en/pro_show.asp?id=1960 available at least as of Nov. 1, 2007.

Qiangli tennis racket with "rebound buckle" (1 page) http://www.qiangli.com/en/pro_show.asp?id=1965 available at least as of Nov. 1, 2007.

Qiangli tennis racket with "rebound buckle" (1 page) http://www.qiangli.com/en/pro_show.asp?id=1963 available at least as of Nov. 1, 2007.

Qiangli Tennis Training Set instructions page (2 pages) http://www.giangli.com/en/tennis.asp?page available at least as of Nov. 1, 2007.

Qiangli Tennis Training Set (2 pages) http://e-catalog.rusbit.com/product/tennis_training_set available at least as of Feb. 1, 2008.

Photograph of GAMMA Tennis Trainer (1 page) available at least as of Jan. 1, 2007.

Fill-n-Drill Tennis Trainer offered by Unique as sold through Holabird Sports online at www.holabirdsports.com (2 pages) available at least as of Jul. 1, 2007.

Web page of ATS Sports showing its GAMMA Tennis Trainer (2 pages) from www.atssports.com/tennis.cfm?prodid=391 available at least as of Jan. 1, 2007.

Advantage, Bozof: Memphian hopes tennis trainer is commercial ace, as shown in commercialappeal.com Memphis, Online, May 1, 2008.

* cited by examiner

RACQUET SPORT TRAINING SYSTEM

STATEMENT OF RELATED APPLICATIONS

This application claims priority to a pending provisional application having U.S. Ser. No. 60/948,006. That application is titled "Tennis Teaching Apparatus." That application was filed on Jul. 5, 2007. The provisional application is incorporated herein in its entirety.

FIELD OF THE INVENTION

The invention relates to the field of sports. More specifically, the invention relates to tennis and other racquet sports. The invention also relates to training systems and teaching methods for racquet sports.

BACKGROUND OF THE INVENTION

The game of tennis is known to be a source of exercise and enjoyment for people around the world. Tennis is also an elegant and exciting sport for spectators. Tennis is particularly popular in Australia, in the United States, and in countries in Europe. A television network known as The Tennis Channel™ has recently been offered, further increasing the popularity of the sport.

Tennis can be a difficult sport to learn. In this respect, a mastery of tennis requires that the player learn many different strokes. Such strokes include forehand topspin groundstrokes, backhand topspin groundstrokes, backhand slices, flat serves, kick serves, approach shots, vollies, half vollies, and other strokes. These strokes are made more difficult to learn due to the length, weight and configuration of the tennis racket, and also due to the need to hit a ball traveling at many different angles, speeds and spins.

A person wishing to learn tennis strokes prior to engaging another player on a court has limited options. They may practice their strokes alone on a wall or "backboard." Alternatively, they may stand on one end of a tennis court and hit multiple balls across the net without a live partner. This generally requires a "basket" of balls. Alternatively still, they may take a lesson from a tennis teaching professional who manually feeds from a basket of balls. Further still, they may use a "ball machine," which again requires multiple balls and a process for set-up.

All of such approaches are good and acceptable. However, many students lack basic hand-eye coordination skills, making the process of hitting balls on a tennis court, even balls that are fed in a controlled manner, frustrating. Therefore, a need exists for a tennis teaching apparatus which may be used by a beginning student to learn basic hand-eye coordination skills. Further, a need exists for a tennis training system which may be used without need of a basket of balls. Further still, a need exists for a training system that is fun, easy to use, and can be adapted to repetitively hit slow-bouncing tennis balls such as a foam ball or a low compression ball.

SUMMARY OF THE INVENTION

The present invention provides a racquet sports training system for hitting a racquet sport ball. Preferably, the racquet sports training system is a tennis training system, and the racquet sport ball is a tennis ball.

In one aspect, the training system includes an elongated, elastic cord having a proximal end and a distal end. The system also includes a vibration dampener configured to be received within a string bed of a racket and operatively connected to the proximal end of the cord. The vibration dampener is operatively connected to the proximal end of the cord by means of an integral loop. The system further includes a connection disc operatively connected to the distal end of the cord. Optionally, the connection disc is operatively and releasably connected to the distal end of the cord by means of an integral loop.

The connection disc has an upper surface and a lower concave surface. The lower concave surface is configured to be adhesively connected to an outer surface of a tennis ball in such a manner that the outer surface of the ball is not punctured. The tennis ball may be any of a pressureless ball, a pressured ball, a low-compression ball, or a pressured ball, all of which have a core. Alternatively, the tennis ball may be either a foam ball or a sponge ball. In one aspect, the training system further comprises a tennis ball that is adhesively connected to the lower concave surface of the connection disc.

The tennis training system may also include a container of adhesive. The adhesive is used for adhesively connecting the lower concave surface of a connection disc to the outer surface of a tennis ball. The training system may also come with a plurality of additional connection discs for adhesively connecting to respective additional tennis balls. In one aspect, the tennis ball is a first tennis ball of a first type, and the training system further comprises a second tennis ball of a second type.

A method of practicing tennis is also provided herein. In one aspect, the method includes connecting a vibration dampener to a string bed of a tennis racket. The vibration dampener has a loop forming an eyelet that is operatively connected to a proximal end of an elastic cord. The elastic cord has a distal end that is operatively connected to a first tennis ball in such a manner that an exterior surface of the first tennis ball is not pierced. The elastic cord also has a proximal end that is operatively connected to the vibration dampener.

The method also includes hitting the first tennis ball with the tennis racket a first time, and receiving the first tennis ball back in response to a rebound caused by the elastic nature of the cord. The first tennis ball may be a pressured ball, a low-compression ball, a pressureless ball, a foam ball or a sponge ball.

The method may further comprise removing the first tennis ball from the distal end of the elastic cord; attaching a second tennis ball to the distal end of the elastic cord; hitting the second tennis ball with the tennis racket a first time; and receiving the second tennis ball back in response to a rebound caused by the elastic nature of the cord.

In one aspect, a first connection disc is adhesively connected to the first tennis ball. Likewise, a second connection disc is adhesively connected to the second tennis ball. Each of the first and second discs comprises (1) a lower concave surface for receiving adhesive and contacting the exterior surface of the respective first and second tennis balls, and (2) a loop forming an eyelet for operatively connecting the distal end of the elastic cord to the disc.

Methods for teaching and practicing tennis are also provided. First, a method for teaching tennis is provided. The method first includes obtaining a tennis training system. The tennis training system may be any of the training systems described above. The training system is obtained and used by a tennis instructor. The instructor need not be a full-time or professional instructor. Next, the method includes demonstrating use of the tennis training system by repeatedly hitting the tennis ball with the tennis racket. The tennis ball rebounds each time it is struck in response to the elastic nature of the cord. Then, the method includes inviting a student to also repetitively hit a tennis ball using a tennis racket having a tennis training system attached thereto.

The tennis balls used by the instructor and the student may be any of a pressureless ball, a pressured ball, a low-compression ball, a sponge ball or a foam ball.

A method of practicing tennis is also disclosed. The method first includes obtaining a tennis training system. The tennis training system has a vibration dampener and an elongated elastic cord. The method also includes removably attaching a tennis ball to a distal end of the elastic cord. The connection is made in such a manner that a core of the tennis ball is not pierced.

The method also includes operatively connecting the vibration dampener to a proximal end of the elastic cord. The vibration dampener has a loop forming an eyelet for providing a connection to the proximal end of the cord. The dampener also has a recess configured to be received in a string bed of the tennis racket.

The method also includes attaching the vibration dampener to the string bed of the tennis racket, hitting the tennis ball with the tennis racket, and then receiving the tennis ball back in response to a rebound caused by the elastic nature of the cord. The method further comprises striking the tennis ball additional times in response to successive rebounds of the ball.

Of interest, the method of practicing tennis may optionally include removing the vibration dampener from the tennis racket and then hitting tennis balls with a partner or a tennis instructor. Alternatively, the method may optionally include removing the elastic cord from the vibration dampener and then hitting tennis balls with a partner or a tennis instructor.

BRIEF DESCRIPTION OF THE DRAWINGS

Other objects, advantages and novel features of the present invention will become apparent from the following detailed description when considered in conjunction with the accompanying drawings.

FIG. 3A is a perspective view of the vibration dampener, in one embodiment.

FIG. 3B is a side view of the vibration dampener of FIG. 3A.

FIG. 3C is an end view of the vibration dampener of FIG. 3A.

FIG. 3D is a top plan view of the vibration dampener of FIG. 3A.

FIG. 3E is a bottom view of the vibration dampener of FIG. 3A.

FIG. 4A is a perspective view of the connection disc, in one embodiment.

FIG. 4B is a side view of the connection disc of FIG. 4A.

FIG. 4C is an end view of the connection disc of FIG. 4A.

FIG. 4D is a top plan view of the connection disc of FIG. 4A.

FIG. 4E is a bottom view of the connection disc of FIG. 4A.

FIG. 7A shows a tennis ball having a core and a matted outer cover such as cotton, wool or synthetic fibers.

FIG. 7B shows a large foam ball.

FIG. 7C shows a sponge ball.

DESCRIPTION OF CERTAIN EMBODIMENTS

Definitions

The term "racquet sports ball" refers to any ball that may be used to play a racquet sport. Non-limiting examples are a tennis ball and a racquet ball.

The term "tennis ball" includes any ball that may be struck by a tennis racket. Non-limiting examples include a conventional pressured tennis ball, a pressureless tennis ball, a foam ball, a sponge ball and a low-compression ball.

Description of Selected Specific Embodiments

Figure 1:
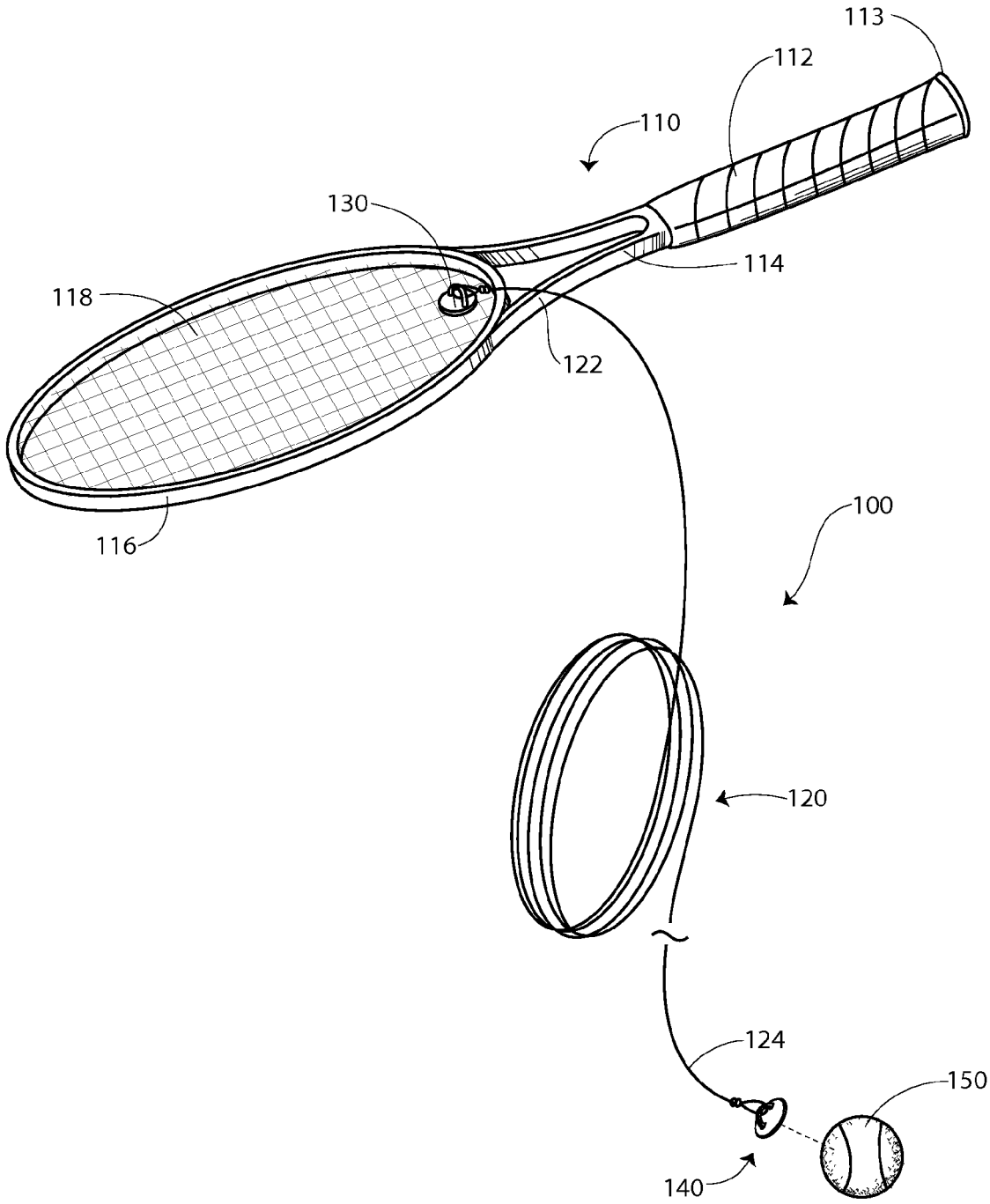
FIG. 1 is a perspective view of a tennis training system of the present invention, in one embodiment. The training system is shown connected to a tennis racket.

FIG. 1 is a perspective view of a tennis training system 100 of the present invention, in one embodiment. The tennis training system 100 is shown connected to a tennis racket 110. The tennis racket 110 may be sold with or as part of a package that contains the tennis training system 100. However, the tennis racket 110 itself need not be part of the training system 100.

The tennis racket 110 shown in FIG. 1 is an adult racket. However, it is understood that the tennis training system 100 is more preferably used with a junior tennis racket. The "standard" adult racket tends to be between 27 inches and 29 inches. These rackets generally weigh between 7.5 ounces and 11.0 ounces, strung. So called "players rackets" or tour rackets may weigh between 11.0 ounces and 13.5 ounces depending on the composition and any added weighting material.

Junior rackets vary in length. The shortest junior rackets are about 19 inches. Junior rackets tend to step up in length by increments of two inches. Thus, junior rackets are typically available in lengths of 19 inches, 21 inches, 23 inches and 25 inches. In some cases a transitional length of 26 inches is offered, such as for beginning adult players.

The tennis racket 110 of FIG. 1 has a grip 112, and a butt 113 at the end of the grip 112. The racket 110 also includes a shaft 114 and a head 116. Generally, the grip 112, the shaft 114 and the head 116 make up the "frame" of the racket 110.

The head 116 of the racket 110 supports a string bed 118. The string bed 118 is used to strike tennis balls such as ball 150 shown in FIG. 1. The string bed 118 typically comprises either a one-piece or a two-piece length of string material that is woven through holes in the head 116. The tension of the string bed 118 may be set according to a player or manufacturer's specifications.

The tennis training system 100 may be used with any adult or junior racket. Moreover, the training system 100 may be used with racquetball rackets or any other type of sports racket that utilizes a string bed. An adult racket 110 is shown in FIG. 1 merely for illustration.

The tennis training system 100 generally includes an elongated elastic cord 120, a vibration dampener 130, and a connection disc 140. As noted, the training system 100 may also be packaged with a sports racquet such as tennis racket 110. Further, the training system 100 may be pre-connected to a tennis ball 150, as will be more fully discussed below.

Referring to the elastic cord 120, the elastic cord 120 may be of various lengths. For instance, if a tennis player wishes to practice vollies, the cord 120 may only be a few feet in length. If the player wishes to practice groundstrokes, the cord 120 may be about 10 to 25 feet in length. If the player wishes to practice serves, the cord 120 may be about 15 to 30 feet in length.

In the preferred arrangement the elastic cord 120 is between 5 and 11 feet in length, depending on the type of tennis ball 150 used. This is the length most suitable for the child, the beginning tennis player and, most likely, the intermediate tennis player. In this length, the tennis training system may be marketed and sold as a toy product for children. The system 100 may alternatively be used by tennis teaching professionals to help children and beginning students develop hand-eye coordination. The system 100 may also be purchased by tennis players and used independently as a precursor or supplement to tennis lessons.

The elastic cord 120 may be fabricated from either natural or synthetic products. Non-limiting examples include latex, gum or other natural rubber, neoprene, viton, a blended rubber/plastic, or hypalon. In one aspect, the cord 120 is a composite of natural rubber and synthetic rubber. In one aspect, a natural rubber core is wrapped with synthetic rubber strands for strength. Alternatively, a natural rubber core is provided, with a synthetic rubber coating. The synthetic rubber coating may be applied over a chlorinated rubber coating. In another embodiment, the elastic cord 120 consists of one or more natural or artificial rubber strings surrounded by a woven jacket fabricated from nylon.

In one embodiment, the elastic cord 120 defines a hollow band. Such a band would include a hollow core (not shown). The outer diameter of such a band may be about 3⁄32-inch to about ¼-inch.

Preferably, the elastic cord 120 is a single strand of natural rubber having an elasticity of about 300% to 400%. This means that the cord 120 can reasonably stretch to three to four times its unstretched length without breaking or becoming plastic. When a lighter ball such as a porous foam ball is used, the cord 120 should preferably have a light weight and be highly elastic. For example, such a cord may have an elasticity of about 250% to 400%. When a heavier ball such as a conventional pressured or pressureless ball is used, the cord 120 should not be quite as light and should have a lower elasticity. For example, such a cord may have an elasticity of about 150% to 300%. The elasticity is a function of different parameters such as thickness, density and composition.

In any event, it is preferred that the cord 120 have an operating temperature between about 0° to 150° F. It is also preferred that the cord 120 have a durometer of between 30Λ and 50Λ, inclusive. Finally, it is preferred that the cord 120 have a tensile strength of at least 30 psi at 150° F., and more preferably greater than 15 psi.

Figures 2, 2A:
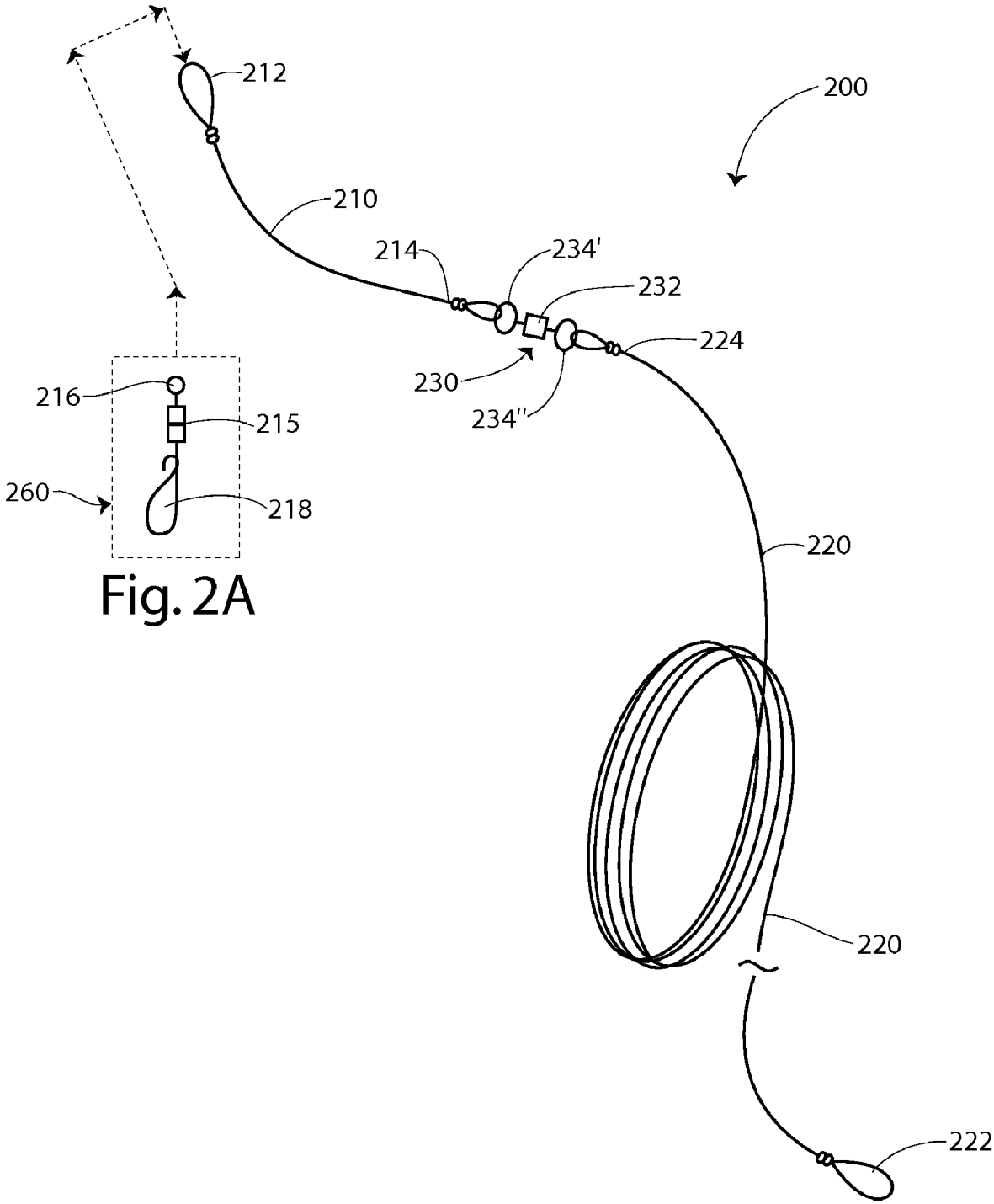
FIG. 2 depicts an elongated elastic cord for a sports racquet as might also be used in the tennis training system of FIG. 1.
FIG. 2A shows an optional snap swivel that may be used to connect an elongated elastic cord to a vibration dampener in the tennis training system.

In one aspect, the cord 120 may be comprised of two separate strands. FIG. 2 depicts an elongated elastic cord 200 for a sports racquet as might also be used in the tennis training system 100 of FIG. 1. Two separate strands are shown at 210 and 220.

The strands 210 and 220 are connected by means of a swivel 230. The swivel 230 comprises opposing eyelets 234', 234". The two eyelets 234', 234" enjoy relative rotational movement. In the illustrative swivel arrangement 230 of FIG. 2, a barrel 232 connects the two eyelets 234', 234" to enable rotation.

Relative to the swivel 230, it can be seen that the first 210 and second 220 strands have distal ends 212, 222, respectively. The distal end 212 of the first strand 210 connects to the vibration dampener 130. Preferably, the distal end 212 defines a loop for readily securing to an eyelet (seen at 135 in FIG. 3A) of the dampener 130. The distal end 212 of the second strand 220 connects to the connection disc 140. Preferably, the distal end 222 also defines a loop for readily securing to an eyelet (seen at 145 in FIG. 4A) of the connection disc 140.

Relative to the swivel 230, the first 210 and second 220 strands also have proximal ends 214, 224, respectively. The proximal end 214 of the first strand 210 connects to one eyelet 234' of the swivel 230, while the proximal end 224 of the second strand 220 connects to the other eyelet 234". The connections may be made by tying knots such as the so-called "fisherman's knot." The swivel 230 helps prevent knotting in the cord 220, particularly near the racket 110.

In one aspect, the two strands 210, 220 of cord 200 have different lengths. For example, the first strand 210 may be about 2 feet to 6 feet, while the second strand 220 may be about 5 feet to 20 feet. Alternatively, the first strand 210 may be about 5 feet to 20 feet, while the second strand 220 may be about 2 feet to 6 feet. Alternatively still, the two strands 210, 220 may be approximately the same length.

In one aspect, the two strands 210, 220 of cord 200 have different properties. For example, the first strand 210 may have a relatively low elasticity, such as about 150% to 300%, while the second strand 220 may have a relatively high elasticity, such as about 250% to 400%. The use of a cord 200 having at least two separate strands 210, 220 is of particular utility when the cord 200 is very long. For instance, if a player wishes to stand on one end of a tennis court and hit the ball 150 across a net and into the other side of the tennis court, then the player will need to have a cord 200 that enjoys a high degree of elasticity. In this respect, the ball 150 will need to extend across the net by stretching so that sufficient energy is loaded in the cord 200 to enable the ball 150 to rebound back to the player. At the same time, the cord 200 should have a low elasticity so that rapid rebound through explosive energy release is not occurring close to the player. By placing a length of cord 210 that has a lower elasticity near the player, the energy of the ball 150 will begin to dissipate before it reaches the player.

In one aspect, two swivels are used along the cord 200. For example, a "snap swivel" or "fisherman's swivel" may be placed between the distal end 212 of the first strand 210 and the eyelet 135 of the vibration dampener 130.

FIG. 2A presents an example of a snap swivel 260. The snap swivel 260 has an eyelet 216 for connecting to the distal end 212 of the first strand 210. The snap swivel 260 also has a snap hook 218 for releasably attaching to the eyelet 135 of the vibration dampener 130. A barrel 215 is provided intermediate the eyelet 216 and the snap hook 218 to provide relative rotational movement between the tennis racket 110 and the cord 200.

It is understood that the snap swivel 260 of FIG. 2A may be used in a cord such as cord 120 that does not comprise two different strands. The snap swivel 260 can help prevent twisting and knotting of the cord 120 during play. In this respect, it has been found that the small-diameter, high elasticity cords sometimes desirable for use in the tennis training system also have a tendency to knot upon twisting.

Elastic cords are available from various sources. Such sources include Price Rubber and Plastics Co. of Baton Rouge, La.; Darcoid of Oakland, Calif.; and Reiss Manufacturing of Blackstone, Va.

Referring again to FIG. 1, the elastic cord 120 has a proximal end 122 and a distal end 124. The proximal end 122 preferably defines a loop that connects to an eyelet 135 of the vibration dampener 130. For example, the loop 122 may be threaded through the eyelet 135, and the dampener 130 then reversed back through the loop to provide a quick and readily reversed connection. It is, however, understood that other connection arrangements may be employed.

Figure 3A:
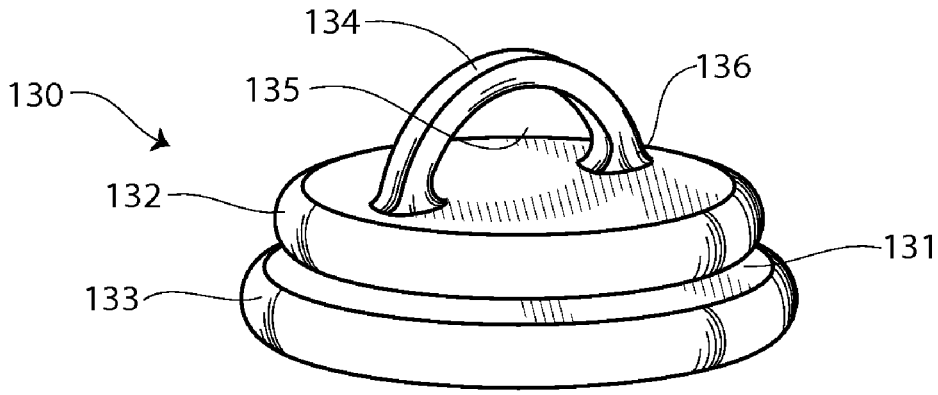
FIGS. 3A through 3E provide drawings of a vibration dampener for a sports racquet as might be used in the tennis training system of FIG. 1.
Figure 3B:
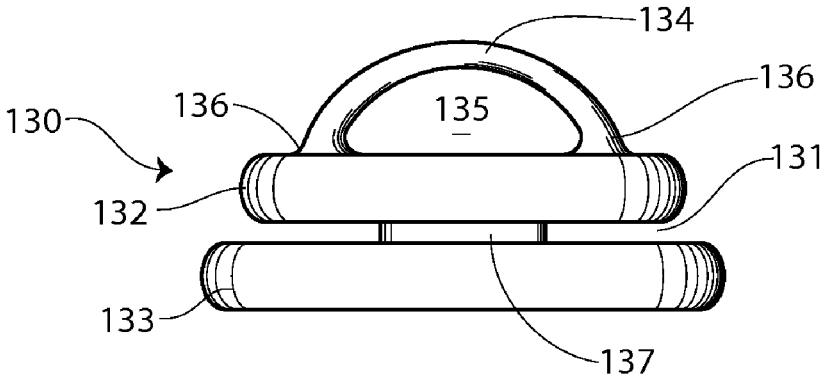
Figure 3C:
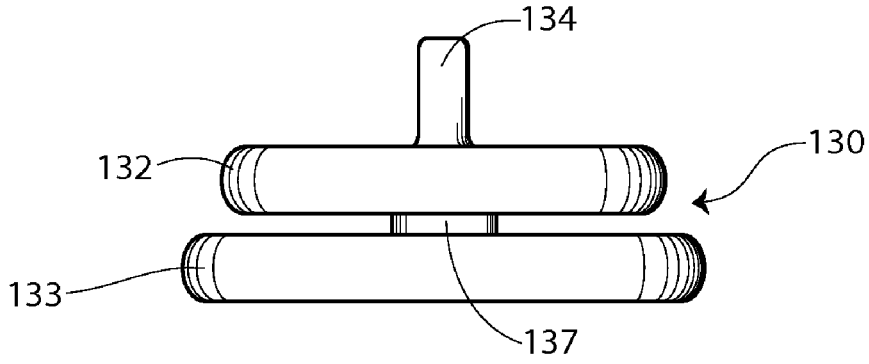
Figure 3D:
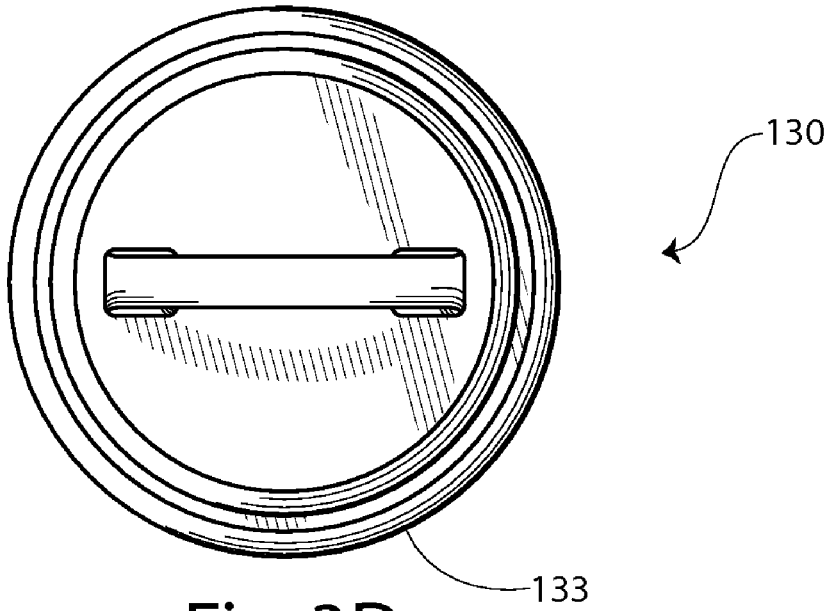
Figure 3E:
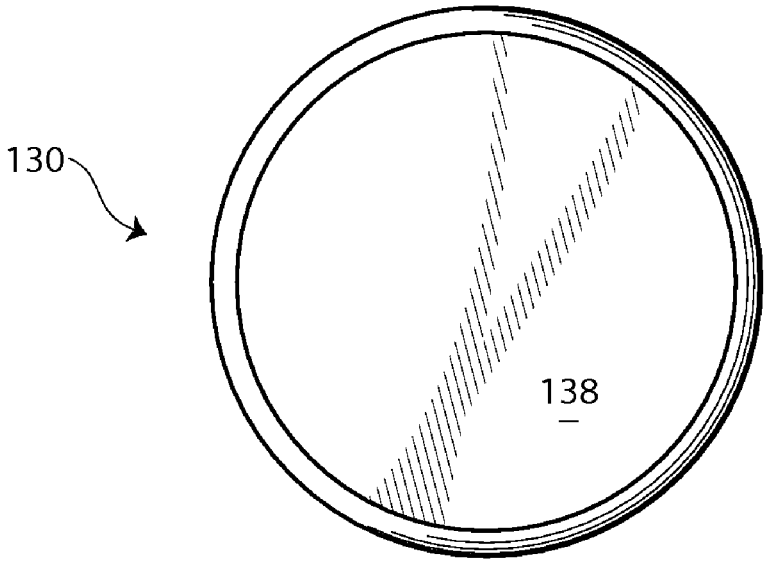

FIGS. 3A through 3E provide enlarged views of the vibration dampener 130, in one embodiment. FIG. 3A is a perspective view of the vibration dampener 130. FIG. 3B is a side view of the vibration dampener 130 of FIG. 3A, while FIG. 3C provides an end view. FIG. 3D shows a top plan view of the vibration dampener 130 of FIG. 3A, while FIG. 3E provides a bottom view.

Referring to FIGS. 3A through 3E collectively, it can be seen that the vibration dampener 130 first comprises an upper body 132 and a lower body 133. In the illustrative embodiment, each of the upper 132 and lower 133 bodies is circular. However, other geometries such as stars, squares or fanciful shapes and designs may be used. The upper 132 and lower 133 bodies are connected by a stem 137. The stem 137 has a diameter that is smaller than the upper 132 and lower 133 bodies so as to form a recess 131. The vibration dampener 130 is preferably fabricated from an elastomeric material.

The dampener 130 is dimensioned to be received into the string bed 118 of the racket 110. In practice, the vibration dampener 130 is inserted into the string bed 118 of the racket 110 much like a conventional vibration dampener or "vibrazorb." In this respect, the recess 131 is dimensioned to be received between two or more strings within the string bed 118 of the racket 110. The player will typically separate the strings anywhere along the string bed 118, though preferably near the shaft 114 of the racket 110, and then insert the dampener 130. The recess 131 between the upper 132 and lower 133 bodies receives strings in the string bed 118. The tension of the strings in the string bed 118 retains the vibration dampener 130 in place during play.

The upper body 132 resides on one side of the string bed 118, while the lower body 133 resides on the opposing side of the string bed 118. The diameter of the lower body 133 preferably is larger than the diameter of the upper body 132. At the same time, the racket 110 is intended to strike the tennis ball 150 on the side of the string bed 118 on which the upper body 132 resides. The larger diameter of the lower body 133 prevents the vibration dampener 130 from pulling through the string bed 118 during play.

Residing on the upper body 132 is a cord connection member. In the arrangement of FIGS. 3A through 3E, the cord connection member is a loop 134. The loop 134 extends over the upper body 132, thereby forming an eyelet 135. Opposing ends of the loop 134 are seen at 136. The ends 136 are preferably integral to the upper body 132 as would be provided through an injection molding process. The eyelet 135 is dimensioned to receive the proximal end 122 of the cord 120. In one aspect, a "fisherman's knot" may be used to form a loop at the end 122 of the cord 120. The loop 122 is then threaded through the eyelet 135 of the dampener 130. Thereafter, the dampener 130 is routed back through the formed loop 122 to create a secure connection. Alternatively, the loop 134 may receive a connector such as snap swivel 260.

The vibration dampener 130 also has a bottom surface 138. The bottom surface resides below the lower body 133. As seen best in the view of FIG. 3E, the bottom surface 138 may be a substantially flat surface. However, it is preferred that the bottom surface 138 incorporate a logo from either a manufacturer or a licensee.

As indicated above, the elongated cord 120 not only has a proximal end 122, but also has a distal end 124. In the illustrative arrangement of FIGS. 1 and 2, the distal end 124 comprises a loop. The distal end 124 of the cord 120 connects to the tennis ball 150.

Figure 4A:
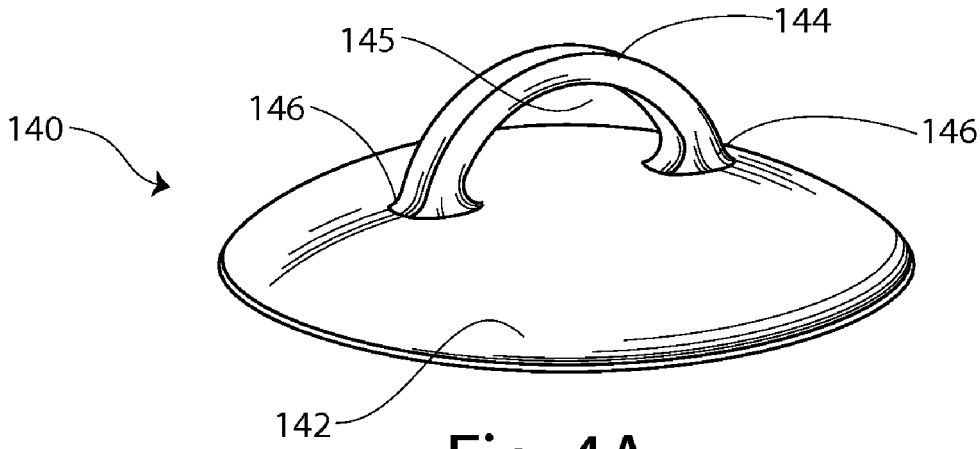
FIGS. 4A through 4E provide drawings of a racquet sports ball connection disc as might be used in the tennis training system of FIG. 1.
Figure 4B:
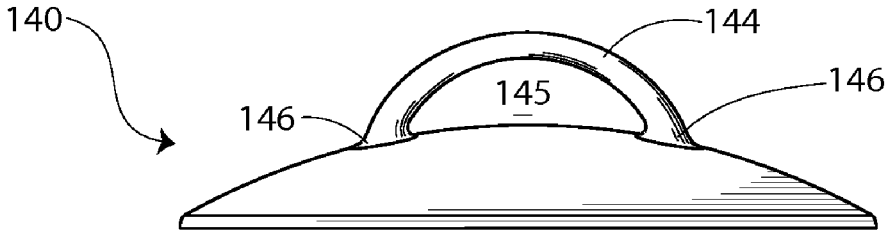
Figure 4C:
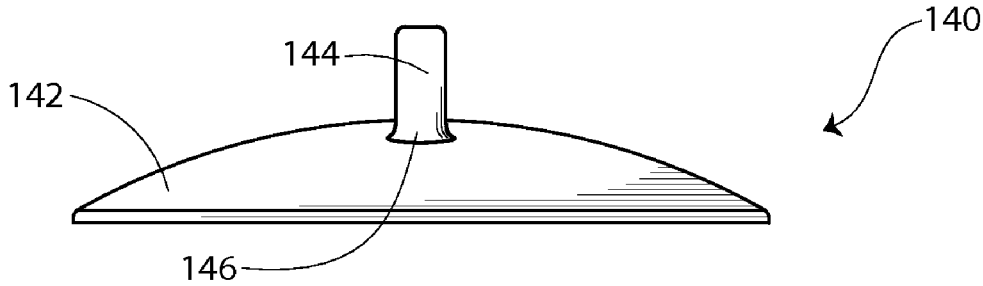
Figure 4D:
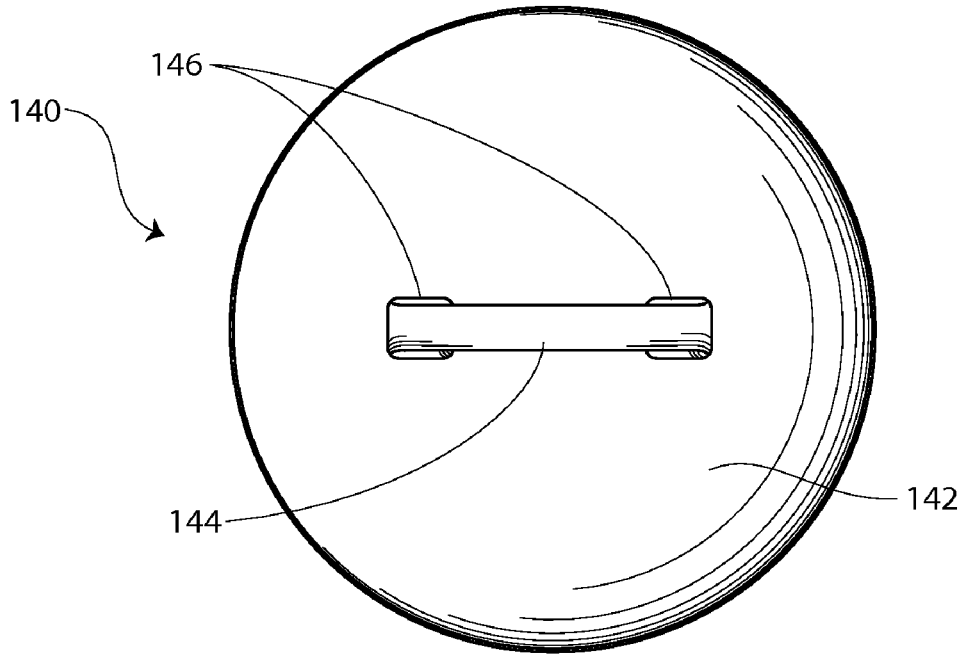
Figure 4E:
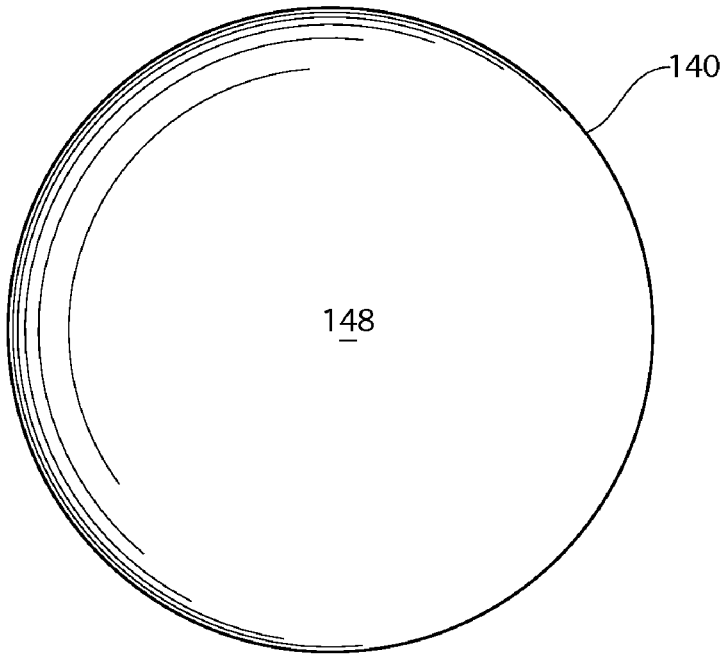

To provide for the connection to the tennis ball 150, the connection disc 140 is provided. FIGS. 4A through 4E provide enlarged views of the connection disc 140, in one embodiment. FIG. 4A is a perspective view of the connection disc 140. FIG. 4B provides a side view of the connection disc 140, while FIG. 4C shows an end view. FIG. 4D provides a top plan view of the connection disc 140, while FIG. 4E shows a bottom view.

Referring to FIGS. 4A through 4E collectively, it can be seen that the connection disc 140 first comprises a body 142. In the illustrative embodiment, the body 142 is round. A bottom surface 148 of the body 142 is seen in FIG. 4E. The bottom surface is concave and may be specially contoured to match the spherical shape of a given tennis ball 150. However, it is preferred that the body 142 be compliant so as to "comply" with the convex surface of tennis balls of any size.

Preferably, the disc 140 is fabricated from a soft, thin, polymeric material. In one aspect, the disc 140 is 1/32" to 1/16" in thickness, and about 3/4" in diameter. However, other sizes may be used depending on the circumference of the ball 150 or designer preference.

Residing on the upper body 142 is a cord connection member. In the arrangement of FIGS. 4A through 4E, the cord connection member is a loop 144. The loop 144 extends over the body 142, thereby forming an eyelet 145. Opposing ends of the loop 144 are seen at 146. The ends 146 are preferably integral to the upper body 142 as would be provided through an injection molding process.

The eyelet 145 is dimensioned to receive the distal end 124 of the cord 120. In one aspect, a "fisherman's knot" may be used to create a loop at the distal end 124 of the cord 120. The loop 124 is then threaded through the loop 142 of the disc 140. The disc 140 is routed back through the formed loop 124 to create a secure connection. Alternatively, the loop 144 may receive a snap swivel 260, although this is not recommended as the swivel 260 would come into contact with the string bed 118 during play. It is understood that other operative connection arrangements may be employed.

In practice, the bottom surface 148 of the disc 140 is coated with a high-strength, quick-drying adhesive material. The adhesive sticks to the standardized felt pile nap of a tennis ball. The ball may be a pressured ball, a pressureless tennis ball or a low compression ball. The adhesive will also stick to the porous exterior surface of a foam ball or to the smooth outer skin of a sponge ball. In one aspect, a treated paper cover having a tab (not shown) is placed over a pre-coated bottom surface 148 of the disc 140 to preserve the adhesive prior to use. More preferably, adhesive is manually applied to the bottom surface 148 of the disc 140 immediately prior to placing the disc 140 onto the tennis ball 150.

Figure 5:
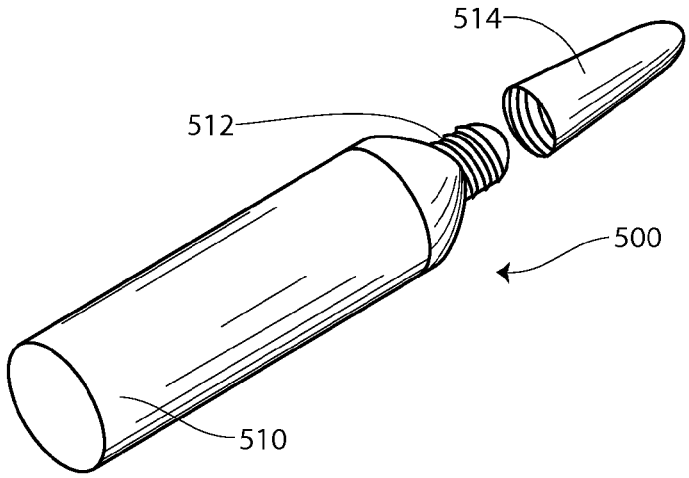
FIG. 5 is a perspective view of a bottle of liquid adhesive as might be used in adhesively connecting a connection disc such as the disc of FIG. 4A to a ball such as any of the balls of FIGS. 7A through 7C.

The adhesive may be provided in the form of a glue stick or in the form of a liquid that is dispensed from a bottle. FIG. 5 provides a perspective view of a small bottle 500 for containing adhesive. The bottle comprises a cylindrical body 510 and a threaded nozzle 512. The threaded nozzle receives a removable lid 514. The adhesive may optionally be included as part of the tennis training system 100 or may be sold to the tennis market separately. In one use, the adhesive may be applied directly to the ball 150 at the point of contact with the disc 140.

The adhesive preferably has a bond strength greater than about 400 psi as measured by ASTM D-905. When the tennis ball 150 is a conventional pressured tennis ball or a pressureless tennis ball, the adhesive should preferably have a bond strength that is at least 10% greater than the tensile strength of the fibers on the cover of the ball 150. When the tennis ball 150 is a foam ball, the adhesive preferably has a bond strength at least 10% greater than the tensile strength of the porous material comprising the ball. When the tennis ball 150 is a sponge ball, the adhesive preferably has a bond strength at least 10% greater than the tear-away strength of the material comprising the smooth outer skin on the ball. In any of these instances, it is more likely that the material around the disc 140 would tear away from itself than that the disc 140 would fall off of the ball 150.

The tennis training system 100 is not limited by the type of adhesive used. In one aspect, the adhesive comprises a cyanoacrylate. Examples of cyanoacrylates include butyl-2-cyanoacrylate (Histoacryl), ethyl-2-cyanoacrylate, and octyl-2-cyanoacrylate. One suitable example is INSTAbond® S-100 available from ACCRAbond, Inc. of Olive Branch, Miss.

In addition, polymers having suitable adhesive properties can be utilized including, without limitation: polyurethanes having amino groups, di- and tri-functional diols; polyvinyl acetates; polyamides; polyvinyl alcohols; polyvinyl pyrrolidone, polyacrylic acid; polystyrene; polylactides; polylactones; block co-polymers including polyesters, polyamides, and polyurethanes; and combinations and mixtures thereof.

A more specific example of a suitable adhesive is one comprising:

(a) water present in an amount of from about 40 percent to about 70 percent by weight;
(b) polyvinyl acetate present in an amount of about 15 percent to about 35 percent by weight;
(c) dextrin present in an amount from about 5 percent to about 35 percent by weight; and
(d) starch present in an amount from about 0 percent to about 5 percent by weight.

The adhesive composition may optionally include at least one water-soluble polymer, such as those selected from the group consisting of cellulose polymers and cellulose gums, including hydroxymethylcellulose, hydroxyethylcellulose and carboxymethylcellulose, hydroxyethylcellulose being preferred; and natural gums (e.g., xanthan gum). Examples of these materials are those sold under the names NATROSOL®, preferably NATROSOL 250 HHXR (hydroxyethylcellulose; commercially available from Aqualon Company), METHOCEL® (hydroxymethylcellulose) and ETHOCEL® E4M (hydroxypropyl methylcellulose; commercially available from Dow Chemical Company), cellulose gum (sodium carboxymethylcellulose; commercially available from Aqualon Company, and under the name Hercules® commercially available from Hercules Inc.).

The adhesive composition may optionally include at least one water-soluble plasticizer for the starch derivatives and/or the water-soluble-polymer(s), such as glycerin, sorbitol, corn syrup, other sugars, and propylene glycol. The adhesive composition also may optionally include at least one water-insoluble plasticizer for the polyvinyl acetate, such as Benzoflex® 9-88 (dipropylene glycol dibenzoate; commercially available from Velsicol Chemical Corporation of Rosemont, Ill.), Santicizer 160 (butyl benzyl phthalate; commercially available from Monsanto of St. Louis, Mo.).

The adhesive composition may also include agent(s) to impart water resistance, such as glyoxal. An example is Glyoxal 40, commercially available from Hoechst/Celanese Corporation. Other optional components include preservatives that may be selected from any appropriate composition, such as para-hydroxyethylbenzoate (ethyl paraben; commercially available from Van Dyk Division of Mallinkrodt, Inc. of Belleville, N.J.; or microbiocides, such as Amerstat® 251, commercially available from Ashland Chemical Company of Boonton, N.J.; or Kathon LX 1.5%, commercially available from Rohm & Haas.

The adhesive composition may also contain dyes or other colorants. For instance, the glue may have an optic yellow tint to blend in with the color of the tennis ball. Such would typically be used in an amount on the order of thousandths of a percent so as to have no effect on the other desirable characteristics of the adhesive.

Variations on the composition, in certain embodiments, are described further in U.S. Pat. No. 6,268,413 entitled "High-Strength Adhesive Paste and Dispenser." The assignee is Elmer's Products, Inc. of Columbus, Ohio. The '413 patent is incorporated herein by reference to the extent not inconsistent with the present disclosure.

Optionally, hook material may be fabricated into the lower surface of the disc 140 in addition to the adhesive. The hook material creates a frictional interface between the disc 140 and the tennis ball 150, at least when the tennis ball 150 has external wool or synthetic fibers. In one aspect, the hook material comprises a plurality of pre-shrunken nylon monofilament hooks having an average monofilament diameter of at least 8.0 millimeters. The hook material may have an average hook height of at least 1.85 mm, an average hook width of at least 1.0 mm, and an average depth of at least 0.6 mm. More preferably, the hook material has an average monofilament diameter of at least 8.25 mm, the average hook height is at least 1.90 mm, the average hook ranges from about 1.1 mm to about 1.3 mm in width, and an average hook depth ranging from about 0.65 mm to about 0.75 mm.

In another option, the bottom surface 148 of the disc 140 includes one or more spikes. Such a disc (not shown) might be used when the tennis ball 150 is a foam ball or a sponge ball. The spikes would be received into the ball to provide lateral support during play. The spikes would not be a substitute for the adhesive, but a supplement.

Figure 6:
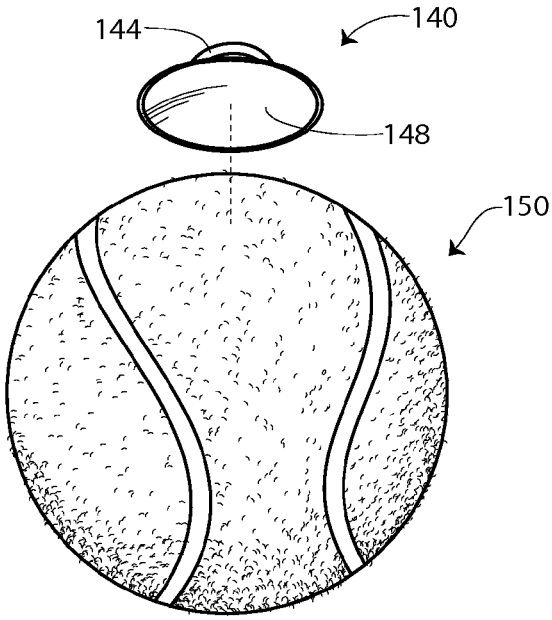
FIG. 6 provides a perspective view of the ball from FIG. 1. A disc is exploded away from the ball.

FIG. 6 provides a perspective view of the ball 150 from FIG. 1. Visible in the view of FIG. 6 is the bottom surface 148 of a disc 140. The bottom surface 148 receives adhesive such as the adhesive contained in the bottle 500.

It is noted that the tennis training system 100 may be packaged with a plurality of discs 140 for adhesively attaching to various tennis balls. Thus, when one ball becomes used or worn, a new ball can be attached to the distal end 124 of the cord 120. The distal end 124 of the cord is removed from that disc and attached to the loop of a new disc. In this instance, the tennis training system 100 would also be packaged with a container of adhesive such as bottle 500. It is also preferred that the tennis training system 100 be packaged with more than one ball 150. For example, the system 100 may have a standard can of three tennis balls. Alternatively, the system 100 may be packaged with both a large foam ball and a low compression ball. In this instance, each ball would preferably have a disc 140 pre-connected thereto.

Figure 7A:
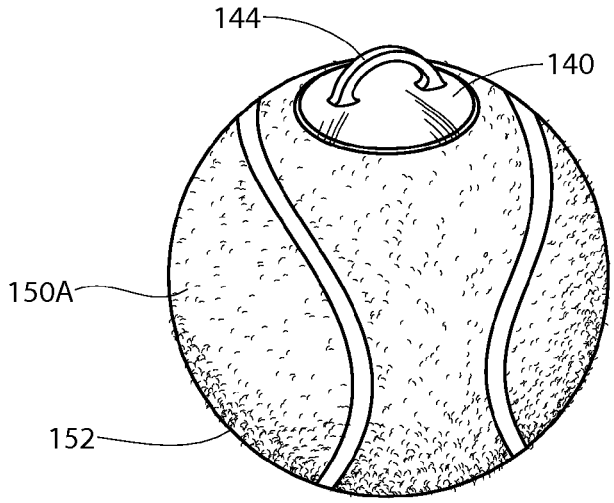
FIGS. 7A through 7C show various types of tennis balls as may be used in the tennis training system of FIG. 1.
Figure 7B:
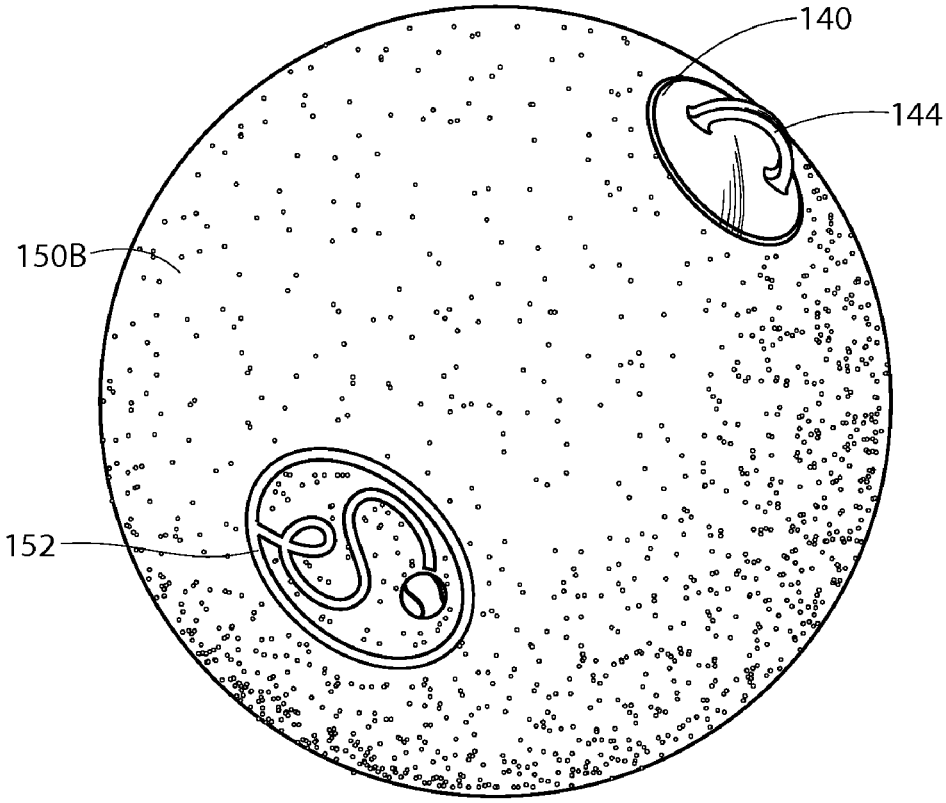
Figure 7C:
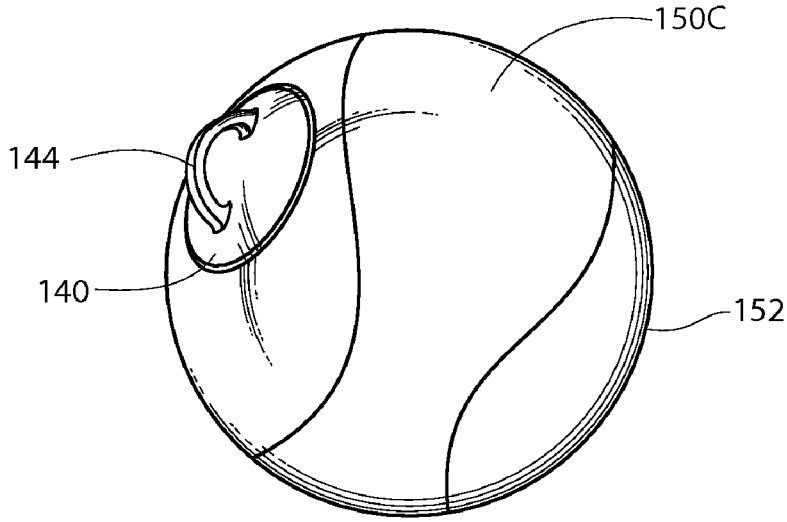

FIGS. 7A through 7C provide perspective views of illustrative tennis balls that may serve as the tennis ball 150 of FIG. 1.

FIG. 7A shows a tennis ball 150A having a matted outer cover having texture such as cotton, wool or synthetic fibers.

The cover forms an outer surface 152 of the ball 150A. The cover is wrapped around a rubber core (not shown). The ball 150A may be a conventional pressured tennis ball, a pressureless ball or a softer "low compression" ball. A connection disc 140 has been affixed to the tennis ball 150A. The loop 144 is seen on the connection disc 140.

FIG. 7B shows a tennis ball 150B that represents a large foam ball. Such balls are manufactured by various tennis companies including Prince Sports of Bordentown, N.J.; HEAD/Penn Racquet Sports of Phoenix, Ariz.; Dunlop Sports Group of Greenville, S.C.; OnCourt/Offcourt, Inc. of Dallas, Tex.; Tretorn offered through Rocky Mountain Sports of Louisville, Colo.; and Wilson Sporting Goods Company of Chicago, Ill. Foam balls are offered as a substitute for conventional tennis balls, particularly in the tennis teaching community. Those skilled in the art of tennis education and training will understand that it can be difficult for a new tennis student to learn strokes using a lively conventional tennis ball. Foam balls are considered to be a desirable alternative due to their slower bounce and their attractive look and feel.

Foam balls 150B do not have a standard diameter. They may range from 700 mm to 950 mm. For instance, the foam ball offered by Tretorn is about 790 mm; the foam balls offered by Wilson Sports and HEAD/Penn are each about 920 mm; and the SpeedBall® offered by Dunlop and the foam ball offered by Prince are each about 890 mm. Each of these five foam balls has a larger diameter than that of a conventional pressured tennis ball, which is only about 620 mm. Of interest, low compression balls have a diameter that is about 680 mm.

FIG. 7C shows a tennis ball 150C that represents a sponge ball. Such balls are manufactured or distributed by GAMMA Sports of Pittsburgh, Pa. and, most likely, others. These balls have a thin and smooth outer skin forming the outer surface 152. The diameters of the GAMMA sponge ball is about 690 mm. This is only slightly larger than the diameter of a conventional tennis ball.

Any of the above balls 150A, 150B, 150C is suitable for use in the tennis training system 100. In addition, the system 100 may be applied with a racquetball or other ball that has previously been developed or might in the future be developed for use with a sports racquet having a string bed.

A method for teaching tennis is also provided herein. In one aspect, the method includes obtaining a tennis training system. The tennis training system may be any of the training systems described above. For instance, the tennis training system may include an elongated, elastic cord having a proximal end and a distal end. A vibration dampener is operatively connected to the proximal end of the cord while a connection disc is operatively connected to the distal end of the cord. The connection disc has a lower concave surface that is attached to a tennis ball. Where the tennis ball has a core, the tennis ball is connected to the disc in such a manner that a core of the tennis ball is not punctured.

The method also includes demonstrating use of the training system to the student. This is done by repeatedly hitting the tennis ball with the tennis racket. The tennis ball rebounds each time that it is struck in response to the elastic nature of the cord.

The method then includes inviting a student to also repetitively hit a tennis ball using a tennis racket having the tennis training system attached thereto. The student strikes the tennis ball, and the tennis ball returns to the student due to the elasticity of the cord.

A method of practicing tennis is also provided herein. In one aspect, the method includes removably attaching a tennis ball to a distal end of a tennis training system. "Removably" means that no cutting is required to sever the connection with the ball. The teaching apparatus comprises an elongated, elastic cord that is connectable to the tennis ball in such a manner an outer surface of the tennis ball is not pierced. The method also includes removably attaching a proximal end of the tennis teaching apparatus to a tennis racket. A vibration dampener is used to connect the racket to the training system. The method then includes hitting the tennis ball. The ball is received back in response to a rebound caused by the elastic nature of the cord. The ball may optionally be struck a second, third, or additional times in response to successive rebounds. The method may then include removing the vibration dampener from the tennis racket, and then playing tennis with an instructor or practice partner.

In another aspect, the method of practicing tennis includes obtaining a tennis training system. The training system may be any of the systems described above. The method also includes removably attaching a tennis ball to the distal end of the elastic cord in such a manner that an outer surface of the tennis ball is not pierced. Also, the method includes operatively connecting the vibration dampener to the proximal end of the elastic cord.

The vibration dampener is attached to or imbedded into the string bed of a tennis racket. The method then includes hitting the tennis ball with the tennis racket. The ball is received back in response to a rebound caused by the elastic nature of the cord. The method further includes striking the tennis ball additional times in response to successive rebounds.

Preferably, the vibration dampener has a loop forming an eyelet for forming the connection to the proximal end of the cord. Likewise, the disc preferably has a connection disc having a loop forming an eyelet for receiving the elastic cord. The method may then further include connecting the elastic cord to the loop of the vibration dampener by tying the cord to directly to the loop or by connecting a snap swivel to the loop of the vibration dampener and then tying the proximal end of the cord to the snap swivel.

The method may further comprise the steps of removing the vibration dampener from the tennis racket, hitting tennis balls with a partner or a tennis instructor. Alternatively or in addition, the method may further comprise removing the elastic cord from the vibration dampener, and hitting tennis balls with a partner or a tennis instructor.

A method of practicing tennis is also provided herein. In one aspect, the method includes connecting a vibration dampener to a string bed of a tennis racket. The vibration dampener has a loop forming an eyelet that is operatively connected to a proximal end of an elastic cord. The elastic cord has a distal end that is operatively connected to a first tennis ball in such a manner that an outer surface of the first tennis ball is not pierced. The elastic cord also has a proximal end that is operatively connected to the vibration dampener.

The method also includes hitting the first tennis ball with the tennis racket a first time, and receiving the first tennis ball back in response to a rebound caused by the elastic nature of the cord. The first tennis ball may be a pressured ball, a low-compression ball, a pressureless ball, a foam ball or a sponge ball.

The method may further comprise removing the first tennis ball from the distal end of the elastic cord; attaching a second tennis ball to the distal end of the elastic cord; hitting the second tennis ball with the tennis racket a first time; and receiving the second tennis ball back in response to a rebound caused by the elastic nature of the cord.

The foregoing description and examples have been set forth merely to illustrate the inventions herein and are not intended to be limiting. Since modifications of the disclosed embodiments incorporating the spirit and substance of the inventions may occur to persons skilled in the art after reading this disclosure, the inventions should be construed broadly to include all variations falling within the scope of the appended claims and equivalents thereof.

What is claimed is:

1. A racquet sport training system, comprising:

an elongated, elastic cord having a proximal end and a distal end;

a vibration dampener releasably connectable to a string bed of a racquet, the vibration dampener being formed as one piece having an upper body and a lower body connected together by a stem disposed between the upper body and the lower body, and an integral loop disposed on the upper body for operatively connecting to the proximal end of the cord, wherein the lower body has a larger diameter than the upper body; and wherein the upper body is insertable between strings of the string bed of the racquet by separating adjacent strings and pushing the upper body and integral loop between the separated strings and above the string bed while the lower body remains below the string bed and the stem is positioned between the adjacent strings; and a connection disc having a formed shape with an upper surface and a lower concave surface, the connection disc being operatively connected to the distal end of the cord, and the lower concave surface being configured to be adhesively connected to an outer surface of a racquet sport ball.

2. The training system of claim 1, wherein:

the racquet sports training system is a tennis training system; and the racquet sport ball is a tennis ball.

3. The training system of claim 2, wherein:

the tennis ball is a pressureless ball, a pressured ball, or a low-compression ball having a core; and the connection disc is connected to the outer surface of the tennis ball in such a manner that the core of the ball is not punctured.

4. The training system of claim 3, further comprising:

a tennis ball, the tennis ball being adhesively connected to the lower concave surface of the connection disc.

5. The training system of claim 2, wherein the tennis ball is a foam ball or a sponge ball.

6. The training system of claim 2, wherein the vibration damper further comprises:

a recess formed between the upper body and the lower body to be received within the string bed of a tennis racquet.

7. The training system of claim 2, wherein the proximal end of the elastic cord is releasably connected to the loop of the vibration dampener by tying the cord to directly to the loop, or by connecting a snap swivel to the loop of the vibration dampener and then tying the proximal end of the cord to the snap swivel.

8. The training system of claim 7, wherein tying the cord comprises:

forming a loop in the proximal end of the cord; and running the loop in the proximal end of the cord through the eyelet of the vibration dampener; and reversing the dampener back through the loop of the proximal end of the cord.

9. The training system of claim 2, wherein the connection disc has a loop forming an eyelet for operatively connecting the distal end of the elastic cord to the connection disc.

10. The training system of claim 9, further comprising:

a container of adhesive for adhesively connecting the lower concave surface of the connection disc to the outer surface of the tennis ball.

11. The training system of claim 2, further comprising:

a plurality of additional connection discs for adhesively connecting to respective additional tennis balls.

12. The training system of claim 2, wherein:

the tennis ball is a first tennis ball of a first type; and the tennis training system further comprises a second tennis ball of a second type.

13. The training system of claim 2, wherein;

the elastic cord comprises a first strand operatively connected to the vibration dampener and a second strand operatively connected to the connection disc; and the tennis training system further comprises a swivel for connecting the first strand to the second strand in such a manner as to permit relative rotational movement between the first and second strands.

14. The training system of claim 13, wherein the elasticity of the second strand is greater than the elasticity of the first strand.

15. The training system of claim 2, wherein the elastic cord is about 5 to 11 feet in length.

* * * * *